US005222425A

United States Patent [19]

Davies

[11] Patent Number: 5,222,425

[45] Date of Patent: Jun. 29, 1993

[54] CYCLIC HYDRAULIC ACTUATOR

[75] Inventor: Michael R. Davies, Johannesburg, South Africa

[73] Assignee: Novatek Drills (Proprietary) Limited, Johannesburg, South Africa

[21] Appl. No.: 817,396

[22] Filed: Jan. 6, 1992

[30] Foreign Application Priority Data

| | | | |
|---|---|---|---|
| Jan. 8, 1991 | [ZA] | South Africa | 91/0127 |
| Apr. 29, 1991 | [ZA] | South Africa | 91/3200 |
| May 6, 1991 | [ZA] | South Africa | 91/3387 |

[51] Int. Cl.[5] ..... F01L 13/16; F01B 7/18

[52] U.S. Cl. ..... 91/273; 91/276; 91/321; 60/370

[58] Field of Search ..... 91/271, 272, 273, 235, 91/276, 277, 281, 325, 321, 417 R; 60/370; 173/207, 208, 135; 175/321, 317; 166/319

[56] References Cited

U.S. PATENT DOCUMENTS

| | | | |
|---|---|---|---|
| 1,639,313 | 8/1927 | Shaff | 173/135 |
| 1,895,153 | 1/1933 | Feucht | 173/135 |
| 2,415,521 | 2/1947 | O'Farrell | 173/135 |
| 2,426,409 | 8/1947 | O'Farrell | 173/135 |
| 4,450.920 | 5/1984 | Krasnoff et al. | 91/224 X |
| 4,474,248 | 10/1984 | Musso | 173/208 X |
| 4,673,162 | 6/1987 | Lachmann | 91/417 R X |
| 4,945,998 | 8/1990 | Yamanaka | 173/207 X |

*Primary Examiner*—Edward K. Look
*Assistant Examiner*—Hoang Nguyen
*Attorney, Agent, or Firm*—Barnes & Thornburg

[57] ABSTRACT

This invention relates to a cyclic hydraulic actuator, and more particularly to an actuator for a rock drill and includes: a housing; at least two chambers in the housing; a fluid passage between a first of the chambers and the outside of the housing for feeding a liquid at supply pressure to the chamber during operation of the actuator; a fluid passage between a second of the chambers and the outside of the housing for exhausting liquid from the second chamber during operation of the actuator; a piston reciprocable on an axis in at least the first and second chambers with the piston including an exposed piston area in each of the two chambers for causing, with the liquid at supply pressure, reciprocation of the piston; an inlet valve for opening and closing the second chamber to liquid at supply pressure in the first chamber; an exhaust valve for opening and closing the exhaust passage; the inlet and exhaust valves, chambers and exposed piston areas being so arranged that during cyclic operation of the actuator, when the inlet valve is closed and the exhaust valve is open, the piston is accelerated in one direction, and when the inlet valve is open and the exhaust valve is closed the piston is accelerated in the opposite direction; means on the piston for opening the inlet valve after closing the exhaust valve, means for closing the inlet valve independently of the exhaust valve, and means biasing the exhaust valve from a position in which it closes the exhaust passage to a position in which the exhaust passage is at least partially open once the inlet valve is closed irrespective of the position of the piston in the remainder of its first direction of acceleration, during the cyclic operation of the actuator.

6 Claims, 6 Drawing Sheets

CYCLIC HYDRAULIC ACTUATOR

FIELD OF THE INVENTION

This invention relates to hydraulic reciprocating machines and more particularly to cyclic actuators such as those used in rock drills and other mining machinery.

BACKGROUND TO THE INVENTION

Hydraulic reciprocating machines are well known with most including a piston which moves sealingly within two or more hydraulic chambers. The piston typically has a stepped diameter which defines differential areas or lands on which the hydraulic fluid pressure can act. At least one chamber of the machine is supplied with liquid at supply fluid pressure. At least one of the other chambers is alternately supplied with supply pressure liquid or is isolated from the supply and is open to an exhaust path to a lower pressure or preferably to atmosphere, as the piston is reciprocated in the two chambers. The fluid access to the second chamber is controlled by inlet and exhaust valves. The differential area of the piston coupled with means for opening and closing the inlet and exhaust valves at appropriate times results in a cyclic reciprocating piston motion. Various valve arrangements and means for causing the valves to operate are known in the art. Hydraulic actuators based on the use of spool valves have been in wide use for decades. Actuators based on the use of poppet valves are, however, a more recent innovation.

In an early form of poppet operated actuator such as that described in U.S. Pat. No. 4,450,920 it was proposed that the drop in drive chamber pressure resulting from the closure of the inlet valve during a cycle be used to open a biased exhaust valve. Further, it was proposed that the flow of fluid into the drive chamber on the opening of the inlet valve be used to close the exhaust valve. This arrangement in practise is wasteful of high pressure supply fluid and frequently suffers from severe cavitation and erosion across the face of the exhaust valve.

An improved actuator is described in South African patent No. 84/9716 which uses the return motion of the piston, more particularly an interaction face on the piston, to open the inlet valve and in addition position part of the exhaust valve between the piston interaction face and the inlet valve in such a way as to ensure the closure of the exhaust valve prior to the opening of the inlet valve. In this manner the wasteful loss of supply fluid, characteristic of the above American patent is overcome. The exhaust valve of the actuator described in the specification is mechanically opened by using a "lost motion arrangement" which shortens the exhaust valve stroke to only marginally less than that of the piston. Problems have arisen in practise with the actuator described in the South African patent in that the exhaust valve stroke is substantially linked to the piston stroke and as a result the valve, on opening, travels at very high velocities and is frequently destroyed mechanically as a result. Additionally, the exhaust valve kinetic energy dissipation against the inlet valve causes undesirable bounce of the inlet valve from its seat, and consequently inefficiency.

SUMMARY OF THE INVENTION

A cyclic hydraulic actuator according to the invention includes: a housing; at least two chambers in the housing; a fluid passage between a first of the chambers and the outside of the housing for feeding a liquid at supply pressure to the chamber during operation of the actuator; a fluid passage between a second of the chambers and the outside of the housing for exhausting liquid from the second chamber during operation of the actuator; a piston reciprocable on an axis in at least the first and second chambers with the piston including an exposed piston area in each of the two chambers for causing, with the liquid at supply pressure, reciprocation of the piston; an inlet valve for opening and closing the second chamber to liquid at supply pressure in the first chamber; an exhaust valve for opening and closing the exhaust passage; the inlet and exhaust valves, chambers and exposed piston areas being so arranged that during cyclic operation of the actuator, when the inlet valve is closed and the exhaust valve is open, the piston is accelerated in one direction, and when the inlet valve is open and the exhaust valve is closed the piston is accelerated in the opposite direction; means on the piston for opening the inlet valve after closing the exhaust valve, means for closing the inlet valve independently of the exhaust valve, and means biasing the exhaust valve from a position in which it closes the exhaust passage to a position in which the exhaust passage is at least partially open once the inlet valve is closed, irrespective of the position of the piston in the remainder of its first direction of acceleration during the cyclic operation of the actuator.

In a preferred form of the invention the first chamber is divided in two with a first portion of the first chamber serving as a supply chamber into which the inlet valve opens and the second portion of the first chamber, on the opposite side of the second chamber, and serving as a return chamber; the piston being located and reciprocal in all three chambers with one exposed piston area being situated in the return chamber to provide the return piston area and a second piston area in the second chamber to provide the drive piston area.

Further according to the invention the exhaust valve is in the form of a sleeve which co-axially surrounds and is spaced from the piston in the second chamber. Preferably a portion of the length of the wall of the second chamber, towards its inlet valve end, is stepped radially outwardly intermediate its ends and the outer surface of the exhaust valve is similarly outwardly stepped with the inner diameter of the valve being less than the drive piston area of the piston and its outer diameter being greater than the drive piston area. The step in the outer surface of the exhaust valve may be open to a liquid passage in the housing with its other end continuously open to liquid at supply pressure hydraulically to bias the exhaust valve towards the inlet valve. Alternatively, the exhaust valve could be biased towards the inlet valve by a spring which bears on the exhaust valve step in the housing.

Conveniently the inlet valve surrounds and is slidable on the piston.

Still further according to the invention the inlet valve bias means is a pick-up member which surrounds and is freely slidable on the piston in the supply chamber over a step in the piston with the step being so positioned on the piston that on the return stroke of the piston it will entrain the pick-up member away from the inlet valve and in the predetermined position of the piston on its drive stroke will be hydraulically biased onto the inlet valve to close the valve prior to the piston reaching the limit of its drive stroke so that continued travel of the piston after closure of the inlet valve will cause a liquid pressure drop in the second chamber to cause the exhaust valve at least partially to open under its bias.

In a variation of the invention the exhaust port in the second chamber may be in the piston and the piston would then include a fluid passage which extends between the port and the drive end of the piston.

BRIEF DESCRIPTION OF THE DRAWINGS

The invention is now described by way of example only with reference to the drawings in which.

DETAILED DESCRIPTION OF THE ILLUSTRATED EMBODIMENTS

Figure 1:
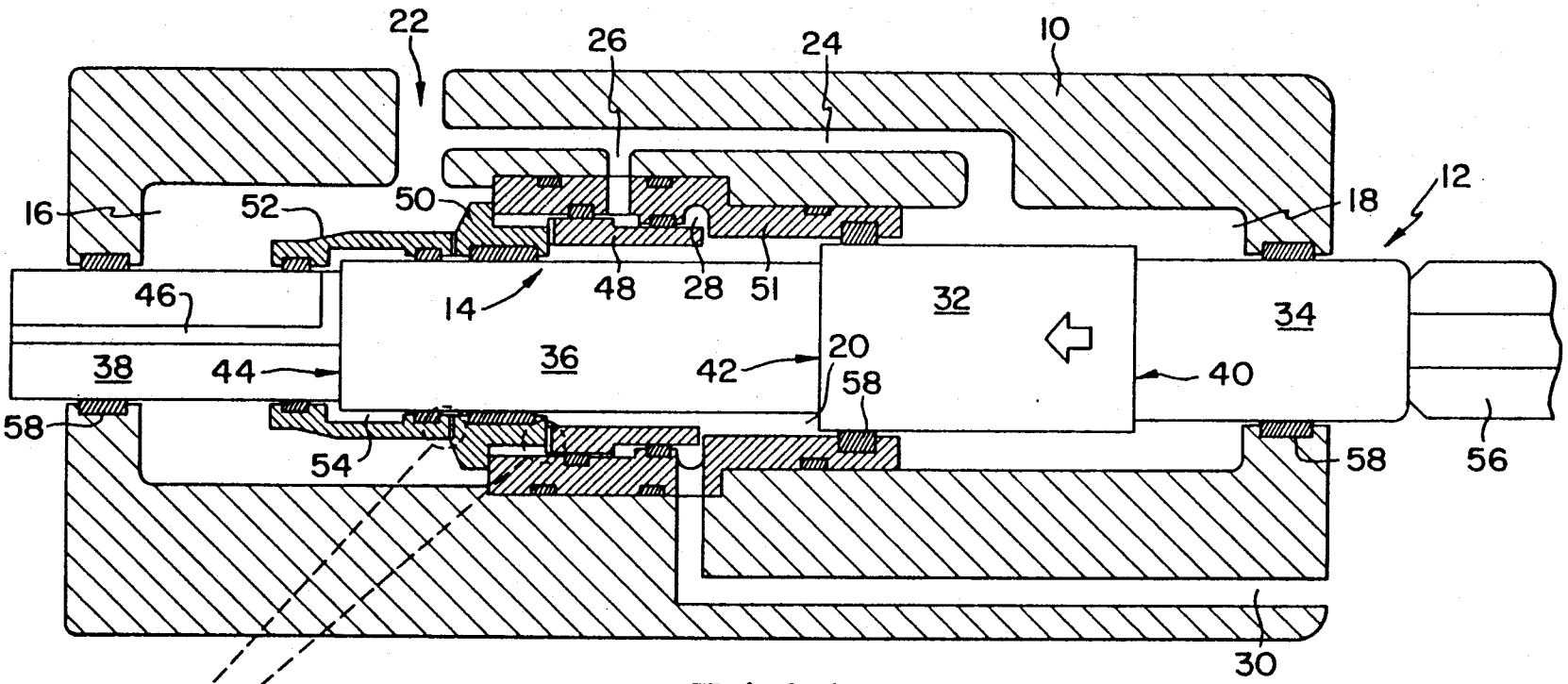
FIG. 1 is a sectioned side elevation of a rock drill with its piston at the beginning of its return stroke.

The FIG. 1 embodiment of the rock drill of the invention is shown in FIGS. 1 to 4 to include a housing 10, a piston 12, and a valve arrangement indicated generally at 14.

The housing 10 includes a supply chamber 16, a return chamber 18, a drive chamber 20, an inlet port 22 into the supply chamber, a fluid passage 24 extending between the inlet port 22 and the return chamber 18, a fluid passage 26 from the passage 24 towards the drive chamber, an annular exhaust port 28 in the drive chamber and a fluid passage 30 connecting the exhaust port 28 to atmosphere on the outside of the housing.

The piston 12 includes four portions 32, 34, 36 and 38 which are downwardly stepped in diametrical measurement from the portion 32 to the portion 38 as shown in the drawing. The stepped portions of the piston provide lands or hydraulically exposed piston areas 40, 42 and 44 on the piston. The piston portion 38 includes a fluid passage 46 which extends from the outer surface of the piston adjacent the land 44 to the free end of the piston as shown in the drawing.

The valve arrangement 14 includes an exhaust valve member 48, an inlet valve 50 and a pick-up member 52 for the inlet valve 50.

The valve arrangement 14 is associated with a housing insert 51 which is fixed to the housing wall in any suitable manner. The purpose of the insert is for ease of assembly and maintenance of the drill but need not necessarily be a separate component and could equally well be integral with the remainder of the housing.

Figure 2:
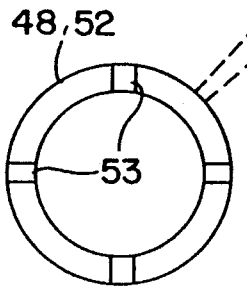
FIG. 2 is an end elevation of the exhaust valve of the FIG. 1 drill.

The exhaust valve member 48 is annular with its inner surface radially spaced from the outer surface of the piston portion 36. The outer surface of the valve member is stepped into a complemental step in the inner wall of the chamber 20, as shown in the drawing, to provide a hydraulically exposed land on the exhaust member which is permanently in communication with the fluid supply passage 26. The forward end of the exhaust valve, at its limit of travel to the right in the drawing, seats on the insert 51 against a reduced diameter portion of the insert to close the exhaust port 28. The rear face of the exhaust valve, on the left in the drawing, carries fluid passage grooves 53 as is seen in FIG. 2.

The inlet valve is slidable on the portion 36 of the piston on a seal bearing, as shown in the drawing and includes a head which seats on the rear face of the insert 51, to close the chamber 20 to liquid at supply pressure in the chamber 16, and a boss which is spaced from inner surface of the insert.

The pick-up member 52 is slidable on the piston portions 36 and 38 on seal bearings as shown in the drawing. The pick-up member includes an annular groove which defines a chamber 54 in the member which, throughout the cyclic operation of the drill, is open to eliminate the possibility of the accumulation of liquid at supply pressure between the pick-up member and the piston which will adversely affect the hydraulic bias of the pick-up member on the piston should one of the pick-up seals leak to atmosphere through the passage 46 in the piston. The front face of the pick-up member carries fluid passage grooves 53 similar to those in the rear face of the exhaust valve.

The piston is guided for reciprocal movement in the housing in seal bearing 58 and the exhaust valve member 48 is similarly guided in seal bearings in the insert 51 which are spaced from each other in the axial direction of the piston on either side of the step in the outer surface of the valve member.

Although only the body of the rock drill is shown in the drawing it does in practise include a front end which carries a conventional chuck and rotor for the drill steel 56.

In use a hydraulic fluid line is connected to the port 22 in the conventional manner and typically mine grade water at a pressure of between 10 and 20 MPa is fed to the port 22 to fill the supply chamber 16, the fluid passages 26 and 24 and the return chamber 18 with the water at the supply pressure. The water pressure sees on the piston, at this stage, only the drive area of the land 40 with a net result being that the piston is biased rearwardly by the pressure acting on the land 40 The inlet valve is strongly hydraulically biased onto its seat on the insert and the pick-up member is biased onto the backface of the head of the inlet valve as shown in the drawing. The pressurized water in the fluid passage 26 acts on the outer land on the exhaust valve member 48 to bias the valve member lightly up against the front face of the inlet valve 50 and from its seat on the insert 51 partially to open the exhaust port 28.

Figure 3:
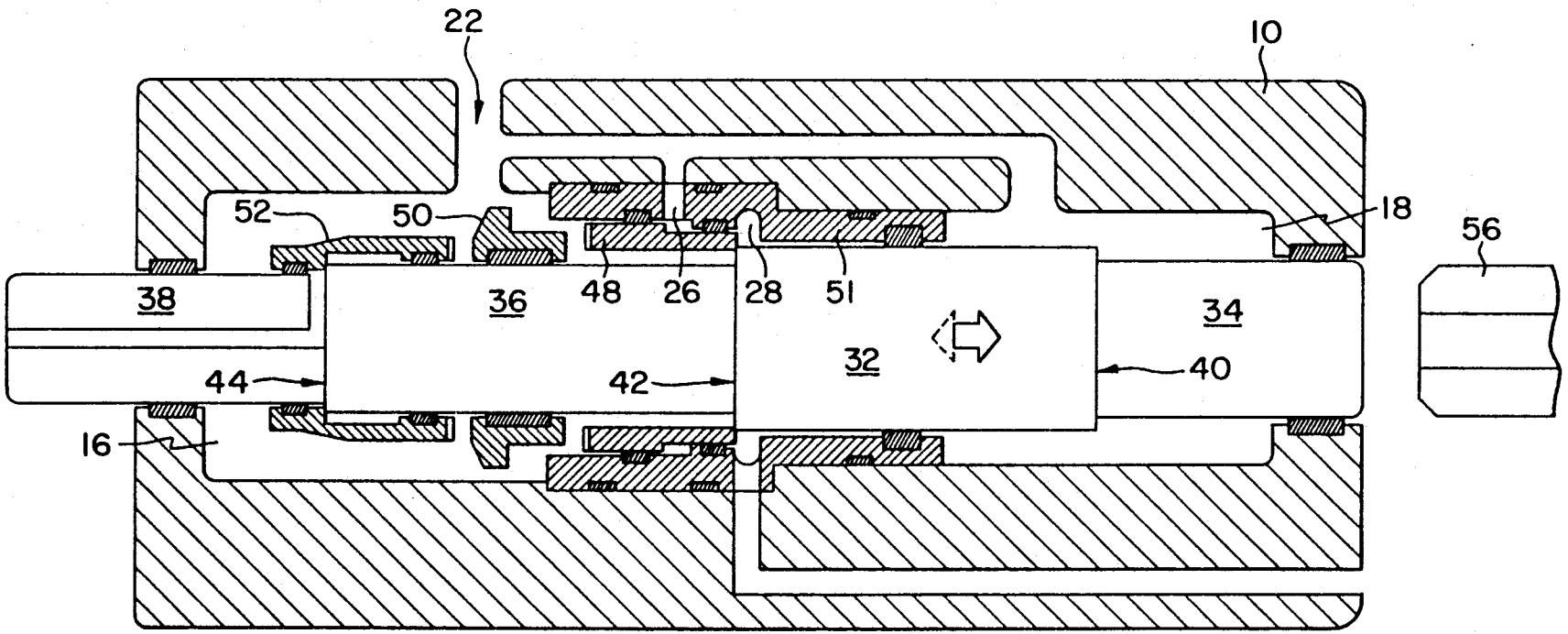
FIG. 3 is a sectioned side elevation of the FIG. 1 drill with its piston at the commencement of its drive stroke.

The cyclic operation of the drill is now described assuming the drill to be operation and commencing with the commencement of a return stroke from the FIG. 1 position. In the FIG. 1 position the impact end of the piston has struck the rear end of the drill steel 56 and bounces from the steel with a rebound velocity to the left in the drawing to commence the return stroke. At the commencement of the return stroke the piston is driven rearwardly by the rebound velocity mentioned above and the water pressure acting on the land 40. As the land 42 of the piston moves rearwardly in the chamber 20 water in the chamber 20 exhausted from the partially open exhaust port 28 and the fluid passage 30 from the housing. When the piston has travelled rearwardly by the short distance which separates the rear face of the chamber 54 in the pick-up member 52 from the land 44 on the piston the land 44 piston towards the left in the drawing away from the inlet valve 50. At this stage the only resistance to the rearward travel of the piston in the housing, other than friction, is the small return chamber bias provided by the water pressure acting on the pick-up member over an area equivalent to the land 44 on the piston. The return stroke of the piston continues until the land 42 on the piston strikes the forward face of the exhaust valve member to move the exhaust valve to the left in the drawing with the foreward portion 32 of the piston then closing the exhaust port. The shock of the impact of the piston land 42 on the exhaust valve is transmitted through the valve to the inlet valve to knock the inlet valve to the left in the drawing from its seat on the insert 51 to about the piston shown in FIG. 3 where it is not acted on hydraulically. As the inlet valve leaves its seat pressurized water from the supply chamber enters the drive chamber 20. The supply pressure water hydraulically couples the exhaust valve to the piston across their contact faces. The grooves in the contact faces of the inlet and the exhaust valves ensure that these two components are not hydraulically coupled. The rear face of the exhaust valve, because of its larger outer diameter than that of the piston portion 32 effectively increases the area of the piston land 42 and so the force applied by the water at supply pressure to the piston. The drive force so generated together with the small pressure acting on the pick-up member 52 rapidly decelerates the piston and reverses its direction of travel into its drive stroke. FIG. 3 illustrates the valve components at this return stroke limit position in the piston cycle. The piston and exhaust valve remain hydraulically coupled in the forward stroke of the piston until the exhaust valve closes the exhaust port and seats on its seat on the insert 51. At this point the piston de-couples from the exhaust valve and continues on its drive stroke being acted on, in the forward direction, by the difference in areas of the lands 42 and 44 on the piston and due to its kinetic energy.

Figure 4:
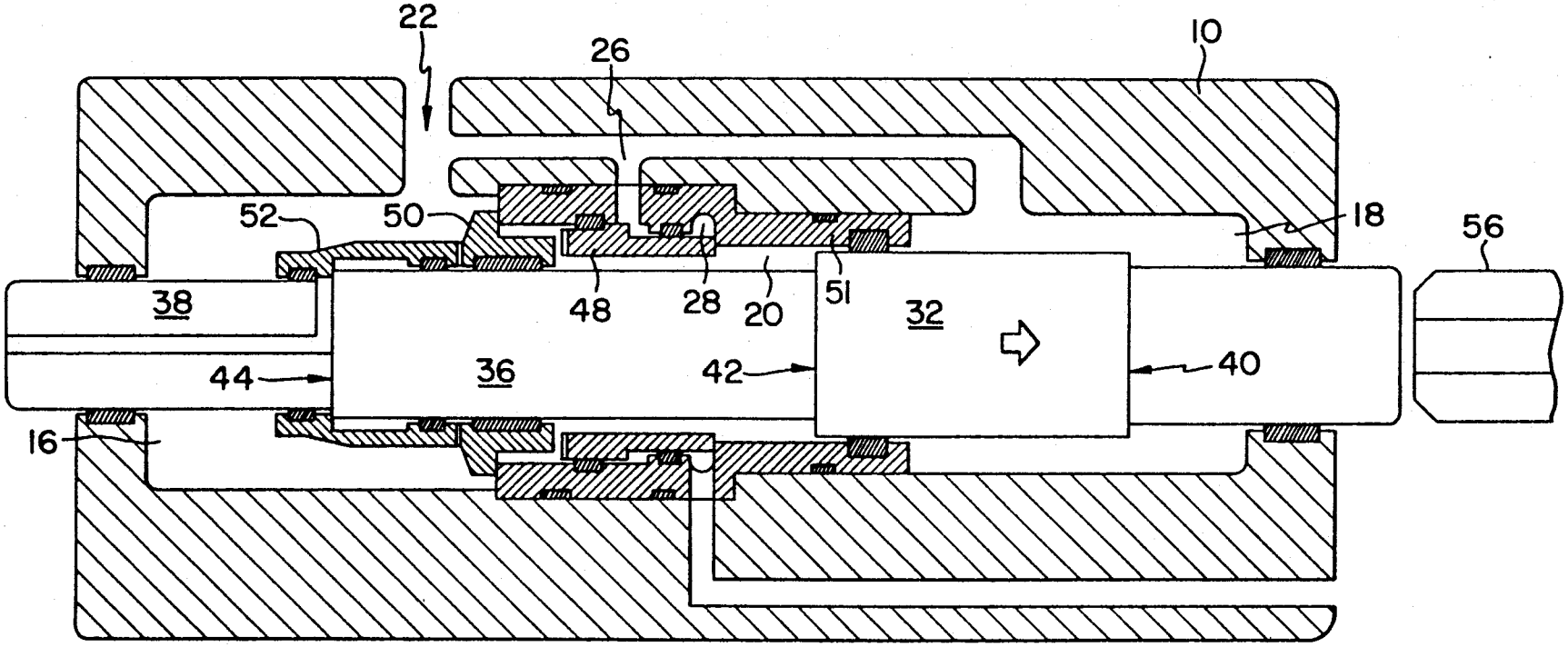
FIG. 4 shows the FIG. 1 and 2 drill with its piston approaching the end of its drive stroke.

At some point during the drive stroke the pick-up member 52, which is hydraulically biased onto the piston land 44, makes contact with the inlet valve 50 and drives the inlet valve to the right from the FIG. 3 position until it makes contact with the seat on the insert 51 to close the valve. At this point in the drive stroke the piston is at its maximum velocity in the cycle with its striker end a short stand off distance from the drill steel as shown in FIG. 4.

The closure of the inlet valve 50 isolates the drive chamber 20 from the water supply pressure while the piston is still moving forwardly and this results in a drop in the drive chamber pressure which breaks the hydraulic coupling of the exhaust valve to its seat on the insert 51 to enable the water pressure bias acting on its outer surface land to shift the exhaust valve rearwardly to abut the front face of the inlet valve and partially to open the exhaust valve as shown in FIG. 1. When the inlet valve and pick-up member are seated the force acting on the land 40 of the piston acts to decelerate the piston but this deceleration force has little effect at this stage on the piston velocity and the piston rapidly bridges the stand off distance and strikes the drill steel. The return stroke then again commences as described above. A critical feature of this invention is that the exhaust port 28 is partially opened by the exhaust valve bias from its FIG. 4 position to its FIG. 1 position by the drop in drive chamber pressure caused by continued travel of the piston to the right in the drawing when the inlet valve has seated. The importance of this is that the exhaust valve 48 is opened on or before the commencement of the return stroke and that the travel of the exhaust valve is small. This arrangement results in the nominal motion of the exhaust valve member 48 being independent of the piston for the greater portion of the piston return stroke with the valve stroke being typically 10% or less of the piston stroke to minimise the difficulties mentioned above in connection with the prior art.

Figure 5:
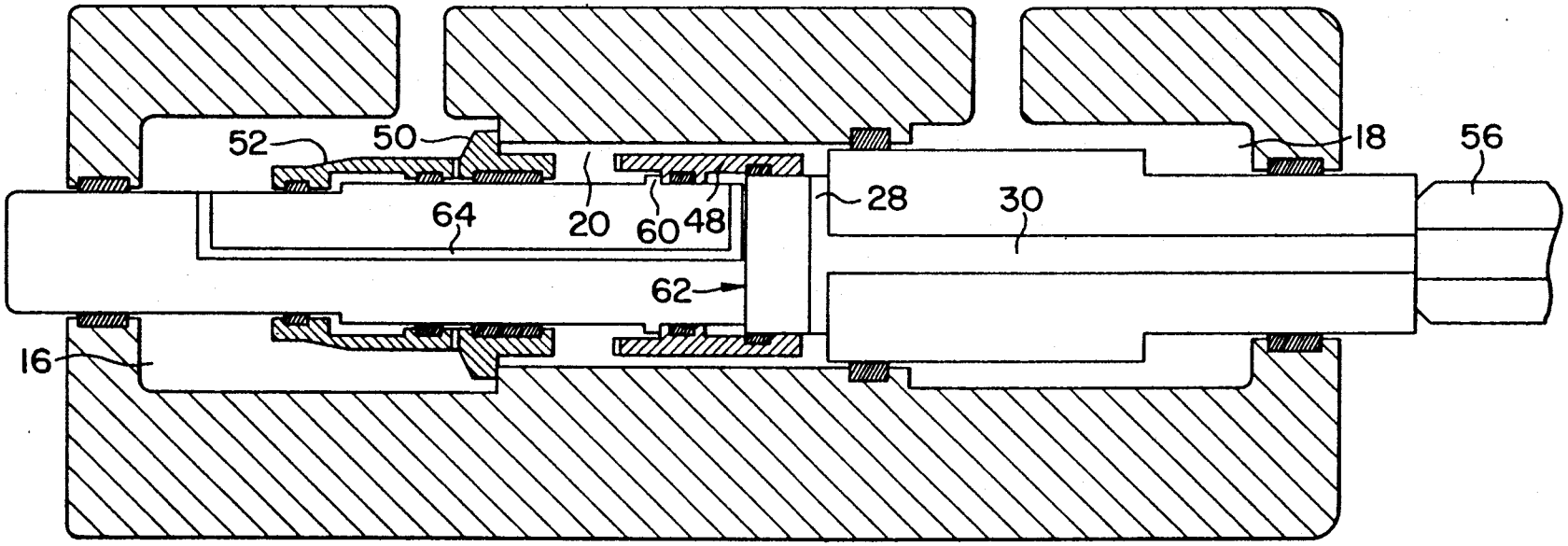
FIG. 5 is a sectioned side elevation of a variation of the drill of FIGS. 1 to 4.

The invention is not limited to the precise details as herein described. For example the pick-up member 52 could be replaced by any suitable biasing arrangement such as a spring which acts between some formation on the housing and the inlet valve. Additionally, as shown in FIG. 5, the exhaust valve 48 could be carried by the piston by an inwardly directed formation which is reciprocal in a groove in the piston between an intermediate land 62 and a flange 60 on the piston. The exhaust valve is biased to the position shown in FIG. 5 by supply water pressure which enters the space between the piston and the surface of the valve member through a fluid passage 64 in the piston. In this embodiment of the invention the exhaust port is not through the housing but is instead through the piston as shown in the drawing. The exhaust water is then fed through the drill steel for hole flushing and dust suppression.

Figure 6:
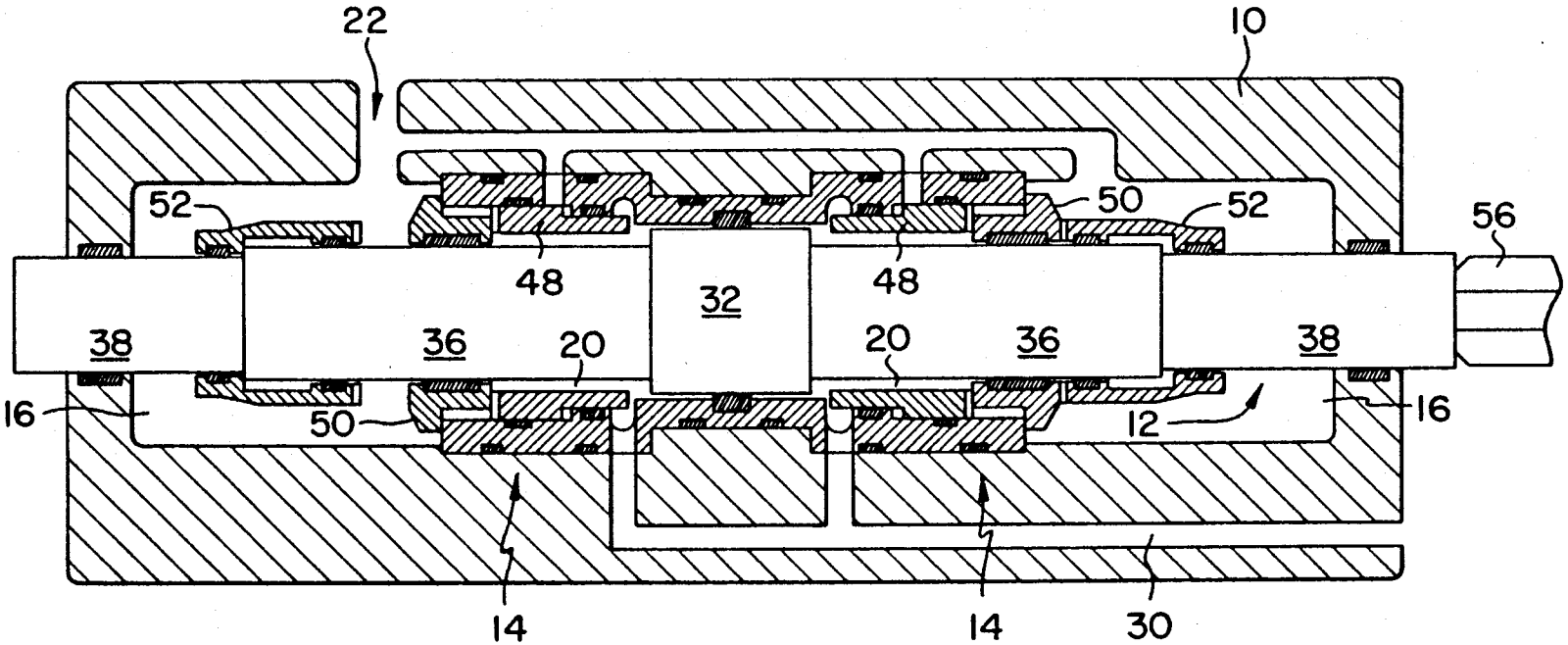
FIG. 6 is a sectioned side elevation of a double acting rock drill.
Figure 7:
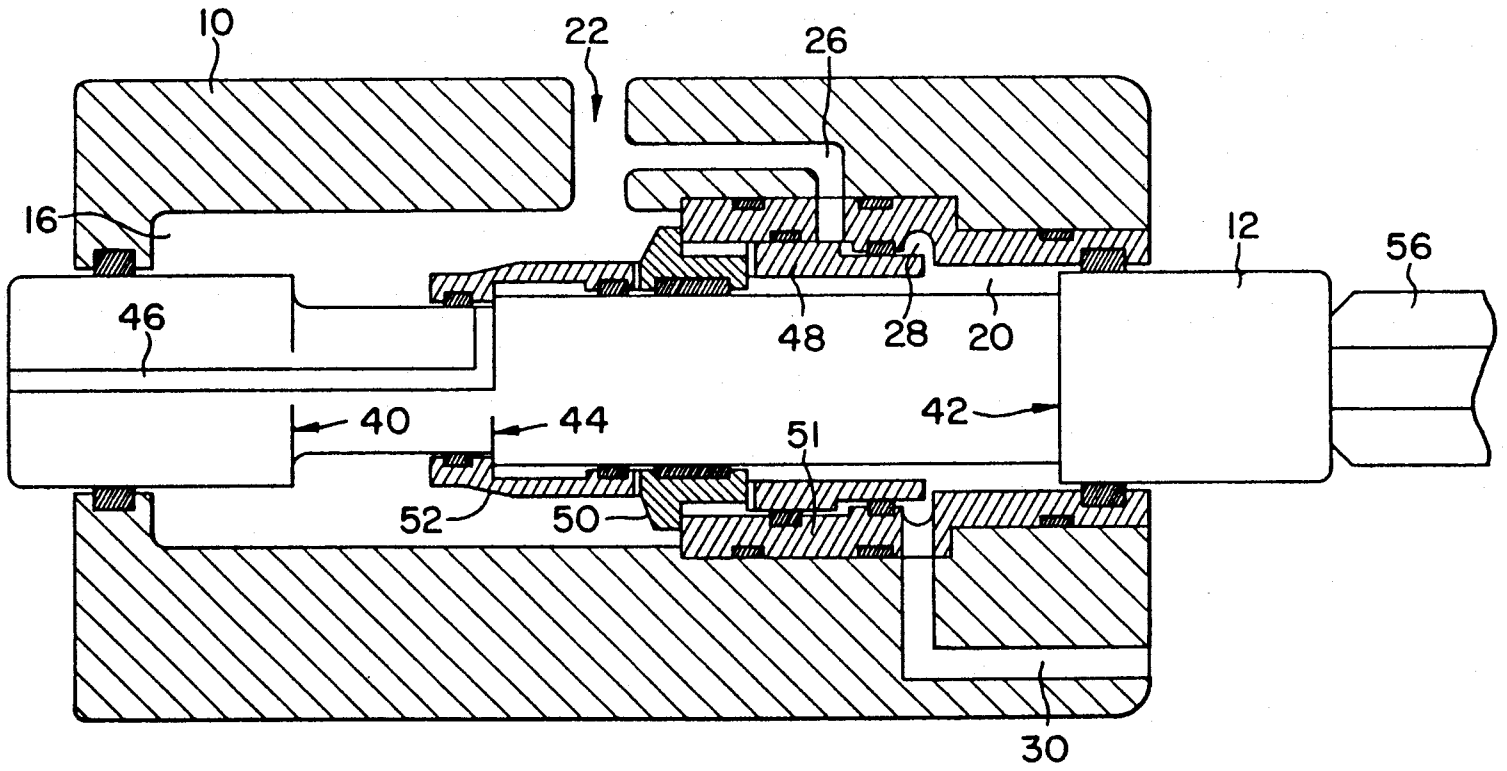
FIG. 7 is a double chamber version of the drill of FIGS. 1 to 4.

This drill operates much in the same manner as those of the previous embodiments in that as the piston moves to the left in the drawing on its return stroke the forward end of the exhaust valve sleeve 48 comes into contact with the inlet valve. The continued movement of the piston to the left in the drawing causes the exhaust ports 28 in the piston to be closed by the exhaust valve 48 sleeve with the land on the piston then coming into contact with the forward end of the exhaust valve sleeve 48 to cause the inlet valve 50 to be opened into the chamber 16 as described with reference to the previous embodiments to initiate the return stroke of the piston. The deceleration and return stroke of the piston is caused by the supply fluid in the chambers 16 and 18 seeing a net force area on the piston equivalent to the difference in diameters of the portions of the piston which pass through the end walls of the housing 10. When the inlet valve closes the chamber 20 and the fluid pressure in the chamber drops due to the advancing piston the exhaust valve is, as required, biased by the supply pressure water through the passage 64 to the position shown in FIG. 1 to open the exhaust ports before the piston reaches the end of its drive stroke. In another variation of the drill, shown in FIG. 6, it is shown that it is possible to have a drill of the invention having four hydraulic chambers: two supply chambers 16 and a drive chamber and a return chamber between the supply chambers. This is achieved by having two back to back valve arrangements 14 which are otherwise identical to that described with reference to FIG. 1. The valve arrangement on the left in the drawing controls the drive stroke while that on the right the return stroke of the piston. The resulting drill thus has two chambers at supply pressure and two chambers with cyclically fluctuating pressures. The various diameters of the piston are sized to give the machine the desired characteristics. Instead of a substantially steady piston force being overcome by a fluctuating drive force as in the embodiments described above this arrangement has two alternately fluctuating forces. The advantage of this arrangement is that the fluid demand is less peaked than that of the previously described embodiments with the only disadvantage being that the machine is increased in mechanical complexity. In yet a further variation of the invention as shown in FIG. 7, it is not necessary to have the supply and return chambers 16 and 18 as separate chambers in the drill housing. Although the drawing looks very different to that of FIG. 1 the principals of operation of the two machines are the same. In the two chamber machine the supply/-return chamber 66 is constantly open to water at supply pressure while the drive chamber alternately sees supply and exhaust pressures in the manner described with reference to FIG. 1.

I claim:

1. A cyclic hydraulic actuator including: a housing, first and second spaced and aligned chambers in the housing, an opening between the two chambers, a piston which is reciprocable in the housing and passes in all stages of reciprocation axially through both chambers and the opening between them, an exposed piston area on the piston in each of the chambers, a fluid inlet from the outside of the housing which is continuously open into the first chamber for supplying fluid at supply pressure to that chamber, an inlet valve member which surrounds and is slidable on the piston in the first chamber between a first position in which it closes the opening between the two chambers and a second position in the first chamber clear of the opening, an exhaust port between the second chamber and the outside of the housing, an exhaust valve sleeve which surrounds the piston between the exposed piston area in the second chamber and the inlet valve and is movable in the axial direction of the piston between a first position in which its one end is contiguous to the inlet valve in its first position and in which the exhaust port is open, a second position to which it is displaced by the exposed piston area in the second chamber, on movement of the piston area in a first piston stroke direction towards the inlet valve, to move the inlet valve to its second position with the piston closing the exhaust port to enable fluid under pressure in the first chamber to enter the second chamber to decelerate and reverse the piston into its second stroke direction and third position to which it is hydraulically drawn by the piston in its second stroke direction to close the exhaust port, means for entraining the inlet valve, with the piston from a predetermined position in its second stroke, to its first position to close the second chamber from the first, and means for biasing the exhaust valve sleeve to its first position after the inlet valve has closed the second chamber from the first and prior to the piston reaching the limit of its stroke in its second stroke direction.

2. An actuator as claimed in claim 1 in which the first chamber is divided in two with each portion of the divided first chamber being situated on opposite sides of the second chamber with a first portion of the divided chamber serving as a supply chamber into which the inlet valve opens and the second portion of the divided chamber serving as a return chamber; the piston passing through and being reciprocable in all three chambers with the exposed piston area in the first chamber being situated in the return chamber to provide the return piston area.

3. An actuator as claimed in claim 2 in which the outer surface of the exhaust valve sleeve is in sliding contact with the wall of the second chamber and its inner surface is spaced from the piston to provide a fluid passage through the valve and the sleeve biasing means is a hydraulic biasing chamber which is defined between the outer surface of the exhaust valve sleeve and the inner surface of the chamber, a radially outwardly stepped portion of the length of the wall of the second chamber, towards its inlet valve end, and a complemental step in the outer wall of the exhaust valve sleeve and a fluid passage for continuously supplying the bias chamber with fluid at supply pressure.

4. An actuator as claimed in claim 3 in which the inner diameter of the exhaust valve sleeve is less than the drive area of the piston and its outer diameter towards its inlet valve end is greater than the drive piston area.

5. An actuator as claimed in claim 1 in which the inlet valve entraining means is a pick-up member which surrounds and is freely slidable on the piston in the first chamber over a step in the piston with the step being so positioned on the piston that during the stroke of the piston in its first direction the piston will entrain the pick-up member away from the inlet valve and in the predetermined position of the piston in its second stroke direction will be hydraulically biased onto the step in the piston to move the inlet valve to its first position prior to the position reaching the limit of its drive stroke so that the continued travel of the piston after closure of the inlet valve will cause a fluid pressure drop in the second chamber which will facilitate the biased opening of the exhaust valve to its first position.

6. An actuator as claimed in claim 1 in which the exhaust port in the second chamber is in the piston and the piston includes a fluid passage which extends between the port and the drive end of the piston.

* * * * *